US007516075B2

(12) United States Patent
Yamamoto

(10) Patent No.: US 7,516,075 B2
(45) Date of Patent: Apr. 7, 2009

(54) HYPERSOUND DOCUMENT

(75) Inventor: Tetsuya Yamamoto, Chiba (JP)

(73) Assignee: Nokia Corporation, Espoo (FI)

( * ) Notice: Subject to any disclaimer, the term of this patent is extended or adjusted under 35 U.S.C. 154(b) by 624 days.

(21) Appl. No.: 10/154,289

(22) Filed: May 23, 2002

(65) Prior Publication Data

US 2002/0184034 A1 Dec. 5, 2002

(30) Foreign Application Priority Data

May 30, 2001 (JP) ..... H2001-163325

(51) Int. Cl.
*G10L 21/06* (2006.01)

(52) U.S. Cl. ..... 704/270.1

(58) Field of Classification Search ..... 704/270.1
See application file for complete search history.

(56) References Cited

U.S. PATENT DOCUMENTS 4,985,697 A * 1/1991 Boulton ..... 715/500.1
5,915,001 A * 6/1999 Uppaluru ..... 379/88.22
5,926,789 A * 7/1999 Barbara et al. ..... 704/270.1
6,249,764 B1 * 6/2001 Kamae et al. ..... 704/270.1
6,859,776 B1 * 2/2005 Cohen et al. ..... 704/270

FOREIGN PATENT DOCUMENTS

EP 0 848 373 A2 6/1998

* cited by examiner

*Primary Examiner*—Susan McFadden
(74) *Attorney, Agent, or Firm*—Harrington & Smith, PC

(57) ABSTRACT

A hypersound document which insures reductions in cost and power requirement of electronic information terminals and a reproducer therefor. The hypersound document has plural pieces of voice data, a time table, and link destinations therein. In an embodiment shown in FIG. 1, "Sound1" for a piece of voice data, a start (t1) and an end (T1) for a time table, and "URL1" for a link destination are associated and stored.

7 Claims, 5 Drawing Sheets

HYPERSOUND DOCUMENT

BACKGROUND OF THE INVENTION

1. Field of the Invention

The present invention relates to a hypersound document and a reproducer therefor, and more particularly to a hypersound document which allows inter-document movement and hearing by a speaker and key operations without a display and a reproducer therefor.

2. Description of the Related Art

In the past, electronic information terminals have been based on visual human interfaces. Although the visual interface is most effective, the display is expensive and consumes a large amount of electric power.

Many people overtax one's eyes in our time because of much visual information such as TV broadcasts, printed matter including newspapers, magazines, and novels, video games, PCs, and CADs. As a result, they become less willing to obtain still more information increasing day by day with their eyes.

It is an object of the invention to provide a hypersound document that can offer a lower-cost and power-thrifty electronic information terminal and a reproducer therefor.

It is another object of the invention to provide a hypersound document for avoiding eyestrain of users and a reproducer therefor.

SUMMARY OF THE INVENTION

To solve the foregoing problems, the invention provides a hypersound document constituted a piece of voice data logically split into a plurality of parts by a time table and descriptor data defining link destinations of the individual parts.

The link destinations of the hypersound document may be other hypersound documents.

In addition, the invention provides a reproducer for a hypersound document constituted a piece of voice data logically split into a plurality of parts by a time table and descriptor data defining link destinations of the individual parts. The reproducer comprises a user-operating unit for generating a trigger and a reproduction unit for reproducing link destinations of the part which was in course of reproduction at the time of generation of the trigger.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the strictures and procedures described herein.

DETAILED DESCRIPTION OF THE PRESENTLY PREFERRED EMBODIMENTS

Figure 1:
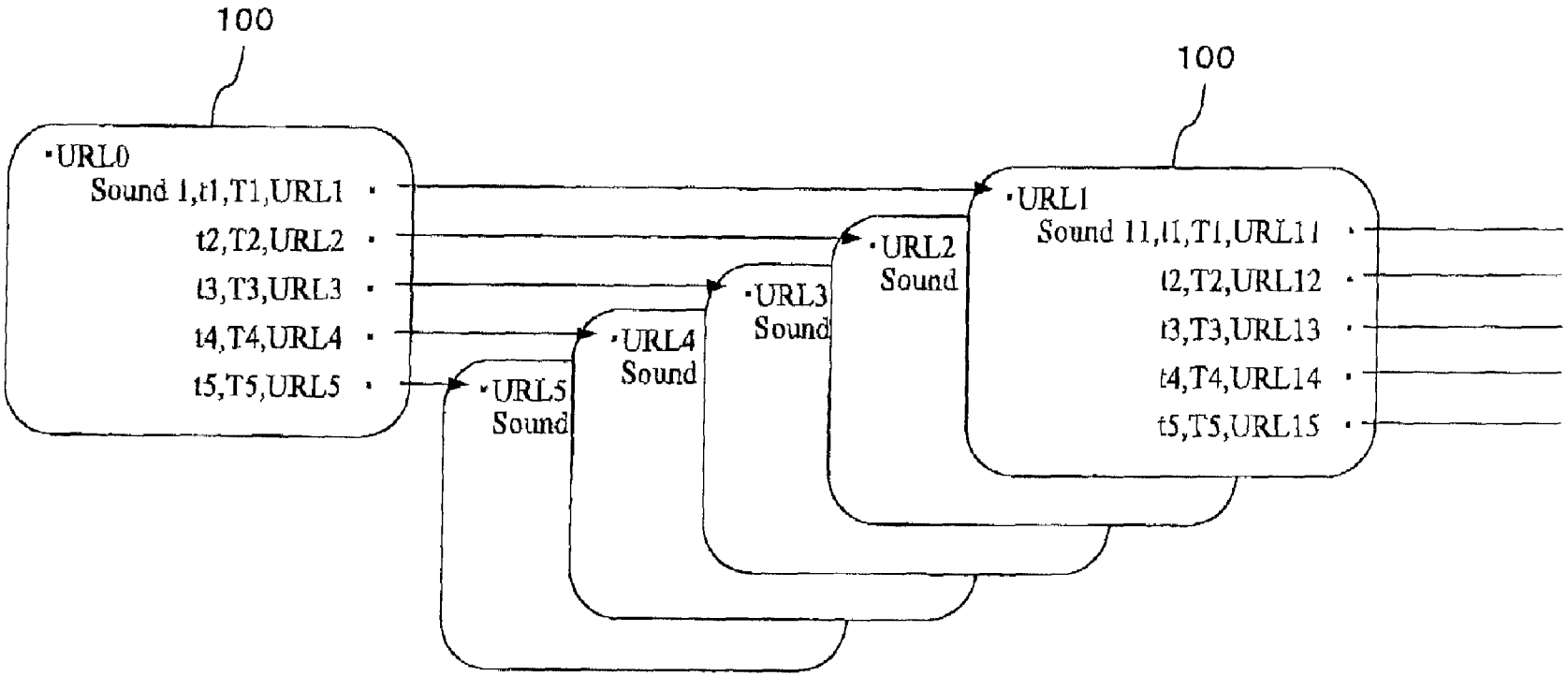
FIG. 1 is a conceptual drawing of a hypersound document of an embodiment according to the invention.
Figure 2:
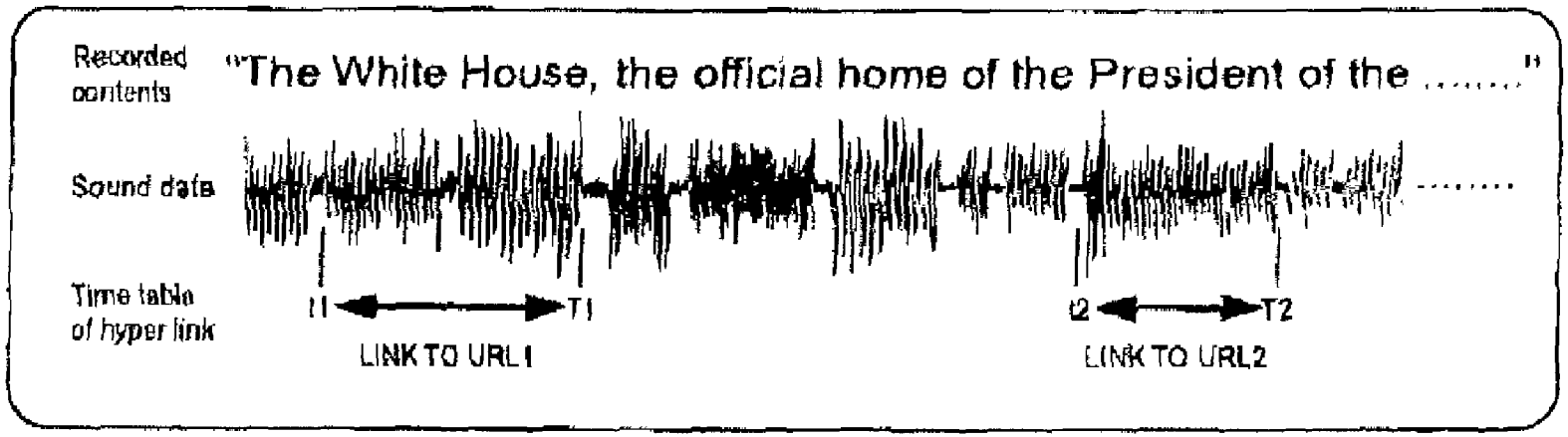
FIG. 2 is a diagram showing a piece of voice data sample in an embodiment of the invention.
Figure 3:
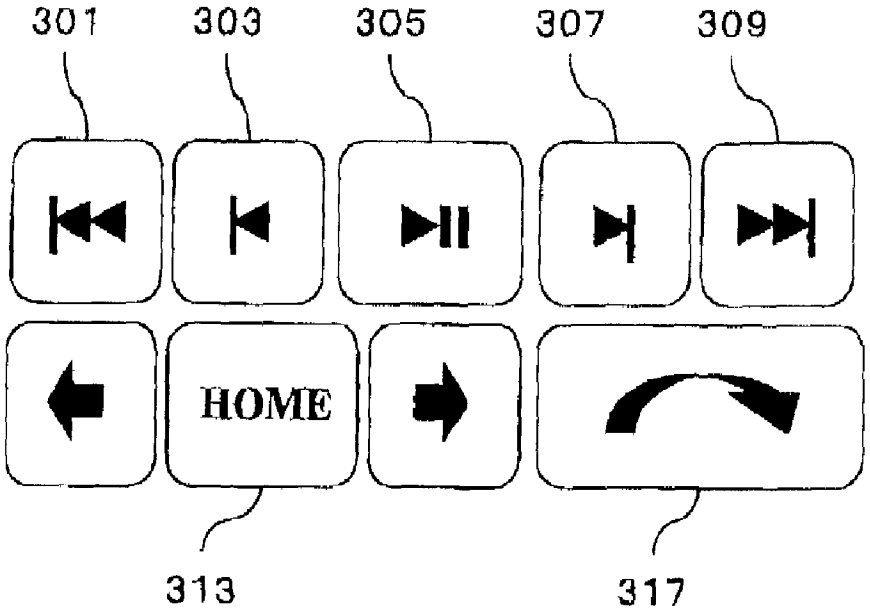
FIG. 3 is a front view showing an operation panel of a reproducer of an embodiment of the invention.
Figure 4:
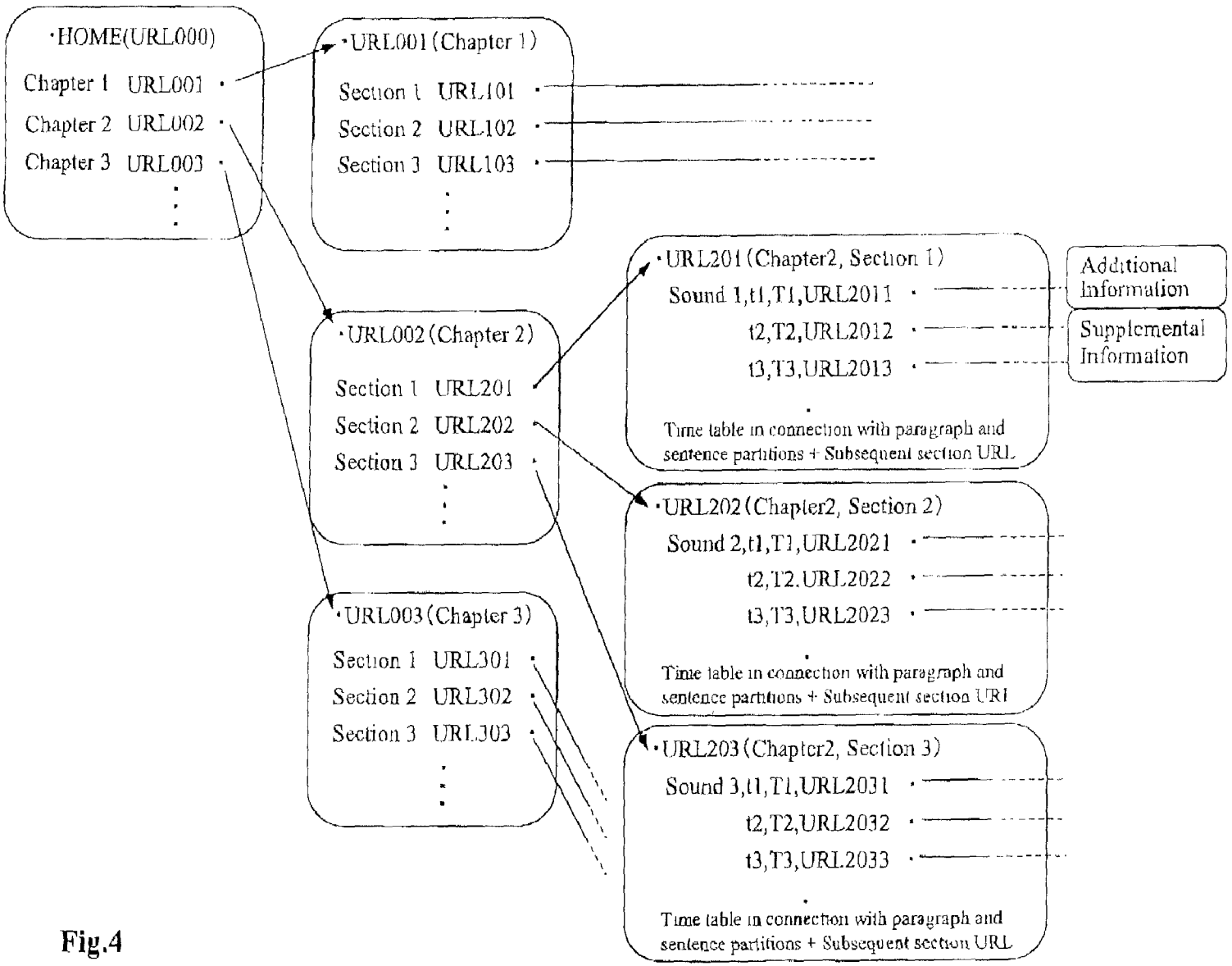
FIG. 4 is a conceptual drawing of a hypersound document of an embodiment of the invention.

The embodiments of the invention will be described in detail with reference to FIGS. 1 to 4, wherein FIG. 1 is a conceptual drawing of a hypersound document; FIG. 2 is a diagram showing a piece of voice data sample; FIG. 3 is a front view showing an operation panel of a hypersound document reproducer; and FIG. 4 is a conceptual drawing in a case where a group of hypersound documents are applied to a novel.

Referring now to FIG. 1, there is shown a concept of a hypersound document of an embodiment of the invention. As shown in FIG. 1, in a hypersound document 100 of an embodiment of the invention, a piece of voice data, plural pieces of interval data, and link destinations are associated therewith and defined. In the embodiment shown in FIG. 1, "Sound1" for voice data, a start (t1: t1 milliseconds after reproducing start, for example) and an end (T1: T1 milliseconds after reproducing start) for interval data, and "URL1" for a link destination are associated and stored. Likewise, a start (t2) and an end (T2) for second interval data and "URL2"for a link destination are associated and stored. "URL1" and "URL2"are also hypersound documents and URL1 to URLn each have a respective hierarchical structure or network structure.

Referring now to FIG. 2, there is illustrated a piece of voice data sample. Waveforms in the middle section thereof show voice data and they can be reproduced, as shown in the upper section, in fact as follows: "The White House, the official home of the President of the . . . . " It is recorded in a lower section time table that a time interval from t1 just short of reproduction of "White House" to T1 immediately after reproducing so is linked to URL1. Also, it is recorded in the time table that a time interval from t2 just short of reproduction of "President" to T2 immediately after reproducing so is linked to URL2. For example, when a user has a trigger generated with an operation switch or the like during or immediately after the reproduction of "White House" in "The White House, the official home of the President of the . . . ", which can be selected on a contents site or hardware site, the current hypersound document moves to a hypersound document URL1 of a link destination, and in turn reproduction of voice data stored in the document is started. Therefore, for instance, it may be possible to provide a hypersound document having a function as a dictionary by storing starting and terminating locations of an abbreviation in voice data (e.g. "FOMC") in a time table and setting as its link destination a hypersound document where voice data representing a translation of the abbreviation (in this case, Federal Open Market Committee) is stored.

In addition, it may be also possible to provide a hypersound document having a function like a voice guidance by stratifying a plurality of hypersound documents. By way of example, the case will be hereinafter described where information concerning various parts of a country is provided by administrative divisions, such as the prefectures plus Tokyo, Hokkaido, Osaka, and Kyoto of Japan.

[1] The Creation of Hypersound Document for the Main Menu (1) A piece of voice data consisting of "Hokkaido, Tohoku, Kanto, Kinki, Kansai, and so on . . . " is separated by districts and the respective reproduction starting and terminating locations are stored in a time table.

(2) Link destinations for the names of districts resulting from the separation with the time table (hypersound documents for sub-menus in this case) are defined.

[2] The Creation of Hypersound Document for Sub-menus (1) A piece of voice data consisting of "Tokyo, Kanagawa-prefecture, Chiba-prefecture, Saitama-prefecture, and so on . . . " is separated by administrative divisions such as the prefectures and Tokyo and the respective reproduction starting and terminating locations are stored in a time table.

(2) Link destinations for the names of administrative divisions resulting from the separation with the time table (hypersound documents storing voice information concerning the administrative divisions in this case) are defined.

[3] An Example of Operation (1) A user can generate triggers, for example, by pressing an operation switch during or immediately after the reproduction of a desired district name (e.g. Kanto), since it is reproduced as "Hokkaido, Tohoku, Kanto, Kinki, Kansai, and so on . . . " when a user accesses a hypersound document for the main menu.

(2) Then, since the current hypersound document moves to a hypersound document for sub-menus and subsequently it is reproduced as "Tokyo, Kanagawa-prefecture, Chiba-prefecture, Saitama-prefecture, and so on . . . ," the user can generate triggers, for example, by pressing an operation switch during or immediately after the reproduction of a desired administrative division name, namely a prefecture name or Tokyo (here, e.g. Tokyo).

(3) Voice information concerning Tokyo is reproduced.

With reference to FIGS. 3 and 4, an embodiment of a hypersound document reproducer will be described below. First, FIG. 4 is a conceptual drawing in the case where a group of hypersound documents are applied to a novel. Initially, on accessing a document in a home (a table of contents), titles of all chapters (Chapters 1 to 3) are reproduced. Pressing a switch 317 during the reproduction of the title of the chapter that the user desires, the user can move to the section branching document of the desired chapter (URL001-URL003 in FIG. 4).

The section branching document also includes voice data (Paragraph 1 title, Paragraph 2 title, Paragraph 3 title, and so on . . . ). Accessing the data causes the section titles to be reproduced. Further, pressing a switch 317 during the reproduction of the title of the section that the user desires, the user can move to a hypersound document corresponding to the section (URL201-URL203 in FIG. 4). The hypersound document stores the sentences of all sections in the form of a piece of voice data and has a time table in connection with the ends of a paragraph and sentence and a subsequent section URL in addition to the above-described link destinations (e.g. link destinations for annotations, additional information, and supplemental information).

FIG. 3 shows an embodiment of an operation panel of the reproducer, wherein pressing each switch 301-317 produces the action as described in the following cases 1 to 7.

1. In the Case of Pressing a Switch 301 During the Reproduction of URL202 (Section 2 of Chapter 2)
   [1] A jump to the section branching document (URL001) of Chapter 1 takes place, where Chapter 1 is the immediately preceding chapter of Chapter 2 which the current hypersound document (URL202) belongs to; and
   [2] The titles of all sections belonging to Chapter 1 are reproduced.
2. In the Case of Pressing a Switch 303 During the Reproduction of URL202 (Section 2 of Chapter 2)
   [1] The immediately preceding sentence of the current sentence in course of reproduction is reproduced.
3. In the Case of Pressing a Switch 305 During the Reproduction of URL202 (Section 2 of Chapter 2)
   [1] The reproduction is stopped temporarily; and
   [2] The reproduction is continued from where it was stopped when the switch 305 is pressed again.
4. In the Case of Pressing a Switch 307 During the Reproduction of URL202 (Section 2 of Chapter 2)
   [1] The sentence following the current sentence in course of reproduction is reproduced.
5. In the Case of Pressing a Switch 309 During the Reproduction of URL202 (Section 2 of Chapter 2)
   [1] A jump to the section branching document (URL003) of Chapter 3 takes place, where Chapter 3 is the chapter following Chapter 2 which the current hypersound document (URL202) belongs to; and
   [2] The titles of all sections belonging to Chapter 3 are reproduced.
6. In the Case of Pressing a Switch 313
   [1] A jump to the hypersound document of the home (e.g. a table of contents) takes place.
7. In the Case of Pressing a Switch 317
   [1] When the current voice data in course of reproduction has any hypersound document linked thereto, a jump to the hypersound document takes place.

While the invention has been described in the context of preferred embodiments, it is not limited by the above description and may be applied to, for example, newspapers, language learning, bidirectional broadcasting, digital household electrical appliances for connecting into the Internet, and manufactured articles for visually impaired persons.

Further, while the embodiments of the invention have been described above, the invention provides the following advantages:

1. Since no display is used, it is possible to perform anything else while obtaining information.
2. Since no display is used, it is possible to cut down on costs.
3. It is possible to ensure reductions in size and power requirement of a portable terminal.
4. It is possible to provide bidirectional voice information.
5. It is possible to provide a digital household electrical appliance which is easy to operate for visually impaired persons.
6. It is possible to provide a web site which is easy to access for visually impaired persons.

Therefore, according to the invention, it is possible to provide a hypersound document that insures reductions in cost and power requirement of electronic information terminals and a reproducer therefor.

In addition, according to the invention, it is possible to provide a hypersound document for avoiding eyestrain of users and a reproducer therefor.

Figure 5:
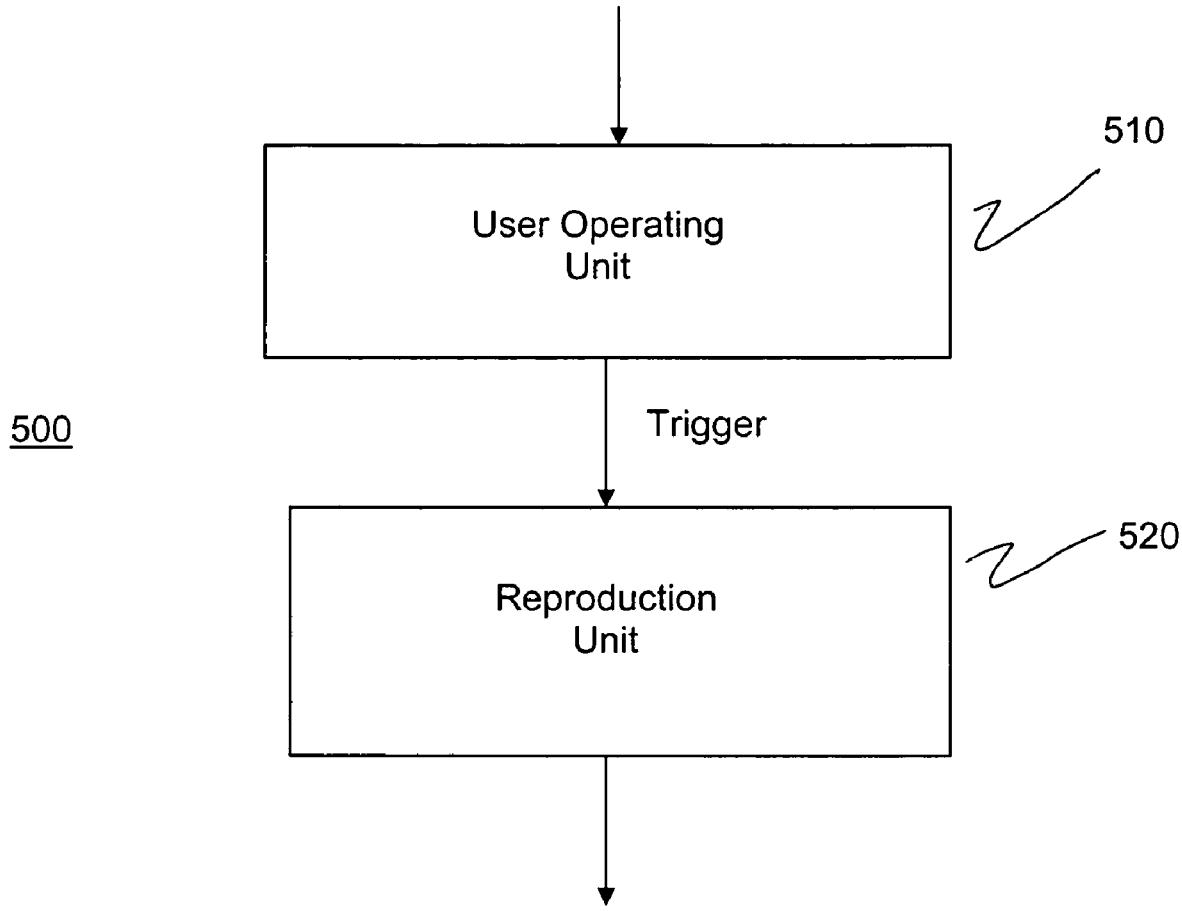
FIG. 5 is a schematic block diagram of a reproducer 500 for reproducing a hypersound document of the present invention.

FIG. 5 is a schematic block diagram of a reproducer 500 for reproducing a hypersound document comprised of a piece of voice data logically split into a plurality of parts by a time table and descriptor data defining link destinations of the individual parts. The reproducer comprises a user-operating unit 510 for generating a trigger; and a reproduction unit 520 for reproducing link destinations of the part which was in course of reproduction at the time of generation of the trigger.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method comprising:

splitting a piece of voice data logically into a plurality of parts by a time table associated with a beginning and an end of each of the plurality of parts, where the parts comprise chapters of the voice data and sections of the chapters, and where the time table is further associated with an end of each sentence of the sections;

generating link destinations of the individual parts;

reproducing the piece of voice data; and determining that a user input occurs between a beginning and an end of one of the plurality of parts of the reproduced voice data and if so, jumping to the respective link destination.

2. The method of claim 1, wherein the link destinations comprise hypersound documents.

3. The method of claim 2, wherein the user input comprises pressing one of a plurality of switches of an operational panel.

4. The method of claim 3, wherein the plurality of switches comprises:

a full-back switch to jump back to a section branching document of a previous chapter in the reproduction of the piece of voice data, the previous chapter comprising titles of the sections in the previous chapter;

a part-back switch to jump back to a sentence previous to a current sentence in the reproduction of the piece of voice data;

a stop switch to stop the reproduction of the piece of voice data;

a part-forward switch to jump to a sentence following the current sentence in the reproduction of the piece of voice data;

a full-forward switch to jump forward to the section branching document of a following chapter and reproduce titles of sections in the following chapter;

a home switch to jump to a home hypersound document; and wherein the said one of the plurality of switches comprises a linked hypersound document switch.

5. An apparatus, comprising:

a first operation switch to produce an action of splitting a piece of voice data logically into a plurality of parts by a time table associated with a beginning and an end of each of the plurality of parts, where the parts comprise chapters of the voice data and sections of the chapters, and where the time table is further associated with an end of each sentence of the sections;

a second operation switch to produce an action of generating link destinations of the individual parts;

a third operation switch to produce an action of reproducing the piece of voice data; and a fourth operation switch to produce an action of determining that at least one particular user input occurs between a beginning and an end of one of the plurality of parts of the reproduced voice data and if so, jumping to the respective link destination.

6. The apparatus of claim 5, wherein a first user input produces an action causing a jump back to a section branching document of a previous chapter in the reproduction of the piece of voice data, the previous chapter comprising titles of the sections in the previous chapter;

a second user input produces an action causing a jump back to a sentence previous to a current sentence in the reproduction of the piece of voice data;

a third user input produces an action causing a stop of the reproduction of the piece of voice data;

a fourth user input configured to cause produces an action causing a jump to a sentence following the current sentence in the reproduction of the piece of voice data;

a fifth user input produces an action causing a jump forward to a section branching document of a following chapter and reproduce titles of sections in the following chapter; and a sixth user input produces an action causing a jump to a home hypersound document.

7. The appparatus of claim 6 embodied on a user terminal.

* * * * *